US006598382B1

(12) United States Patent
Yoo

(10) Patent No.: US 6,598,382 B1
(45) Date of Patent: Jul. 29, 2003

(54) BRACELET

(76) Inventor: Tae woo Yoo, 807, 1-Dong, Hanyang Apt., 32-5, Banpo-Dong, Seocho-Ku, Seoul (KR)

( * ) Notice: Subject to any disclaimer, the term of this patent is extended or adjusted under 35 U.S.C. 154(b) by 0 days.

(21) Appl. No.: 10/147,166

(22) Filed: May 16, 2002

(30) Foreign Application Priority Data

Jan. 16, 2002 (KR) ..... 2002-1307

(51) Int. Cl.[7] ..... F16G 13/18; A44C 5/02
(52) U.S. Cl. ..... 59/80; 59/82; 63/4
(58) Field of Search ..... 59/78, 80, 82; 63/4

(56) References Cited

U.S. PATENT DOCUMENTS 1,443,654 A * 1/1923 Schmidt ..... 59/80
1,728,266 A * 9/1929 Fassnacht ..... 59/80
1,734,625 A * 11/1929 Heyman ..... 59/80
1,820,576 A * 8/1931 Mealy ..... 63/3
2,022,397 A * 11/1935 Zeitz ..... 63/4
2,165,115 A * 7/1939 Schultheiss ..... 63/4
3,682,603 A * 8/1972 Pompeo ..... 63/4
6,289,664 B1 * 9/2001 Bourquin et al. ..... 59/80

* cited by examiner

*Primary Examiner*—David Jones
(74) *Attorney, Agent, or Firm*—Richard M. Goldberg

(57) ABSTRACT

A bracelet includes a series of nonferrous metal units, each of the metal units including a body part having connection holes in opposite sides at one end and having several elongated grooves in an inner surface thereof, right and left connection parts extending from the body part and having protruded rods such that adjacent metal units are linked together by the engagement of the connection holes with the protruded rods, each connection part having elongated grooves in an inner surface, and gold rods inserted into the elongated grooves of the body part and the connection parts so as to protrude partially out therefrom; a locking member at one end of the series of nonferrous metal units; and a linking member at an opposite end of the series of nonferrous metal units for connecting with the locking member to secure the bracelet around a wrist of a person.

4 Claims, 6 Drawing Sheets

BRACELET

BACKGROUND OF THE INVENTION

The present invention relates to a bracelet and more particularly, to a bracelet comprising a series of nonferrous unit members connected with one another and having gold rods. Each unit member has a body part and connection parts, and these parts have grooves in the inner surface and gold rods inserted thereinto in a protruding manner. The bracelet according to the present invention provides an acupuncture stimulation effect caused by the protruded gold rods and also prevents disease by electrical conduction generated from the contact of the nonferrous metal units carrying anions with the gold rods carrying cations, and thereby accelerates cell or nerve activation.

Bracelets are generally provided in various forms and have been used as ornaments and as accessories. However, there has been a need for a bracelet which is functional as well as ornamental.

Korean Utility Model Registration No. 153397 is believed to meet such a need. A bracelet according to this utility model comprises a series of press pellets connected to one another via a connecting member, a lock member connected to one end thereof and a link member connected to the other end thereof. Each of the press pellets has protrusions at both edges of the inner surface and holes to which connecting members are inserted. Even though the bracelet provides an acupuncture stimulation effect, it has the drawback of not providing sufficient stimulation on widely distributed acupuncture points on the wrist with acupuncture protrusions. It also does provide good visual design effects because of the series of press pellets that are linked. In addition to this utility model, there has been a bracelet in which protrusions are provided on the inner surface to impart an acupuncture stimulation effect. Even though it can provide some acupuncture stimulation effect, such metal bracelet neither provides sufficient help to activate cells or nerves nor prevents disease because it is made of only one kind of metal. Thus, there has not existed a bracelet that can provide both its own functions and sufficient stimulation effects.

SUMMARY OF THE INVENTION

The present invention is created to solve the aforementioned problems. The object of the present invention is to provide a bracelet which can provide both an acupuncture stimulation effect and prevent disease by electrical conduction generated from the contact of nonferrous metal units carrying anions with gold rods carrying cations, and thereby accelerate cell or nerve activation.

The bracelet according to the present invention comprises a series of nonferrous metal unit members, a lock member connected to one end thereof and a link member connected to the other end thereof. Each metal unit member includes a body part and connection parts. The body part has connection holes in both sides, and the left and right connection parts have protruding rods. The metal units are linked by the connection holes and the protruded rods. The body.part has several grooves in the inner surface and the connection parts have long grooves in the inner surface. The gold rods are inserted into the grooves in a protruding manner. The bracelet according to the present invention can provide acupuncture stimulation effect caused by the protruded rods when these contact the skin. Also, when the bracelet is put on a wrist, the contact of nonferrous metal carrying anions with gold rods carrying cations accelerates the tendency of ionization of anions and cations, and thereby accelerates electric activation of acupuncture points on the wrist. Such electric activation enables the bracelet to accelerate activation of cells or nerves, and thereby prevent diseases.

BRIEF DESCRIPTION OF THE DRAWINGS

The objects and features of the present invention will be hereinafter explained in detail with reference to the accompanying drawings.

DETAILED DESCRIPTION

Figure 1:
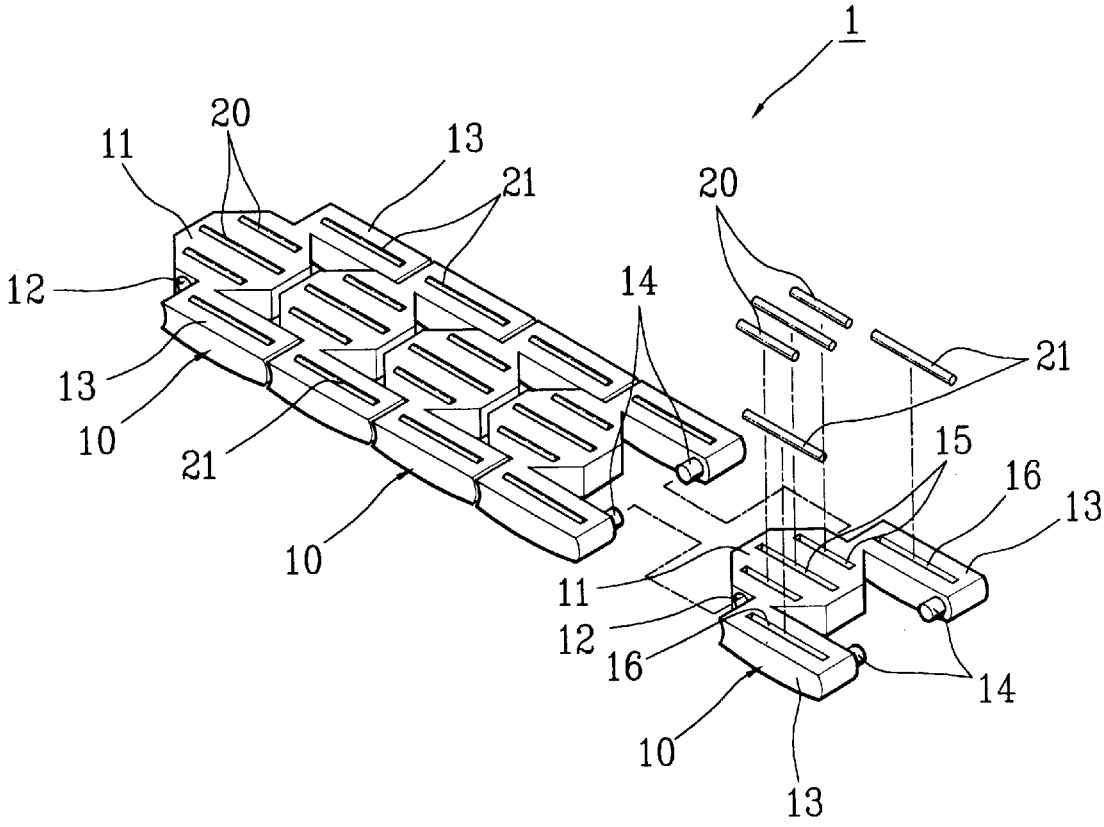
FIG. 1 is an exploded perspective view of the inner side of the nonferrous metal units according to a first embodiment of the present invention.

As shown in FIG. 1, a bracelet 1 according to the present invention comprises a series of nonferrous metal units 10, a locking member 100 at one end and a linking member 200 at the other end. Each metal unit 10 includes a body part 11 having connection holes 12 in both sides at one end, and right and left connection parts 13 extending as legs from body part 11 and having protruded rods 14 at the opposite end. Metal units 11 are linked by connection holes 12 and protruded rods 14. Body part 11 has several grooves 15 in the inner surface and connection parts 13 have long grooves 16 in the inner surface. Gold rods 20, 21 are inserted into grooves 15 and 16 and protrude partially out therefrom.

Figure 2:
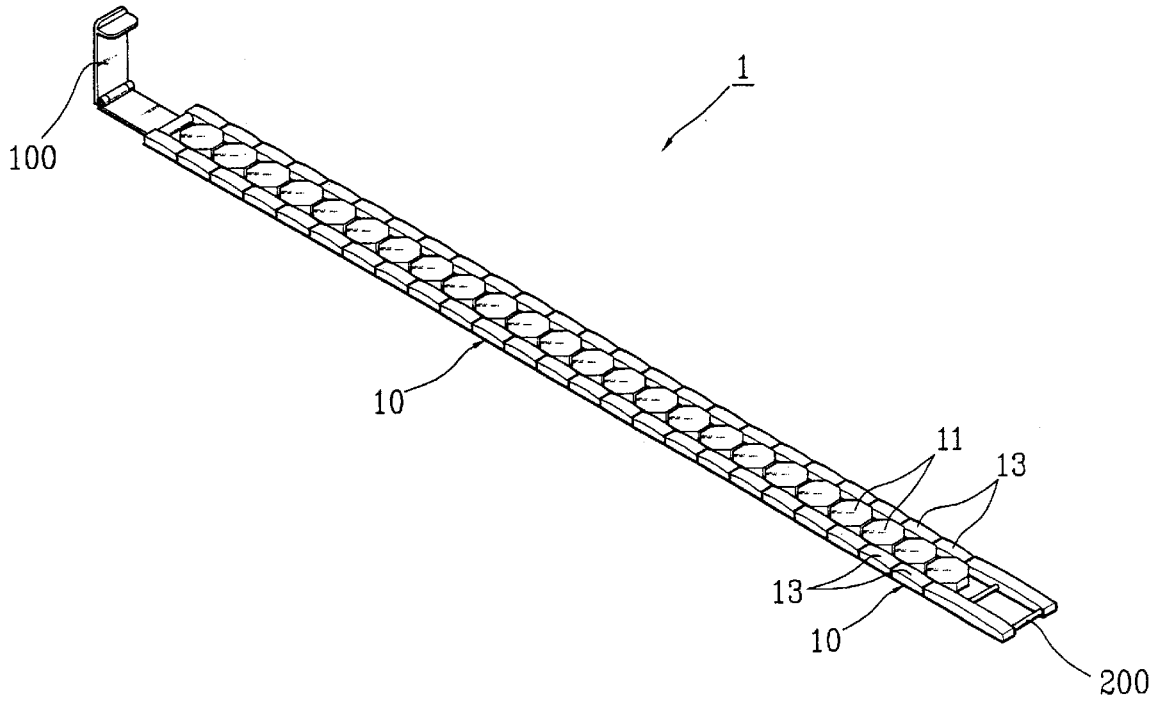
FIG. 2 is a perspective view of the bracelet of the present invention.

In bracelet 1, as shown in FIG. 2, a plurality of nonferrous metal units 10 are connected with one another and a locking member 100 and a linking member 200 are linked at each end so that bracelet 1 can be secured around a wrist 300 of a person.

Figure 3:
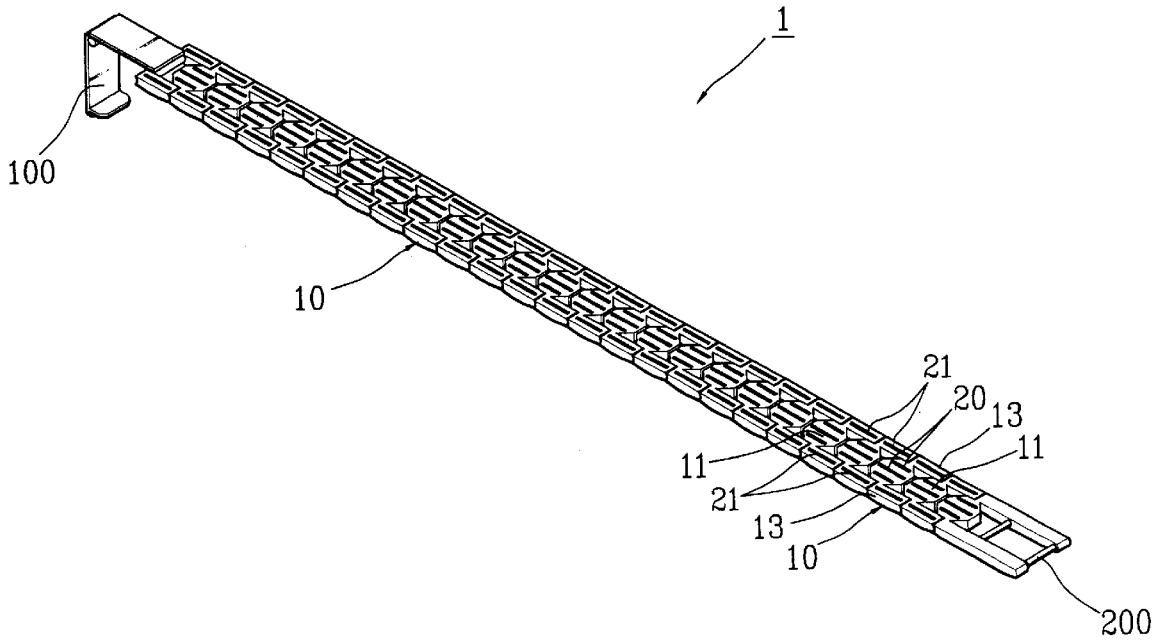
FIG. 3 is a perspective view of the inner side of the bracelet.

As shown in FIG. 3, bracelet 1 has gold rods 20, 21 inserted in the inner surface of body part 11 and connected parts 13 of nonferrous metal units 10 and which protrude partially out therefrom.

Figure 4:
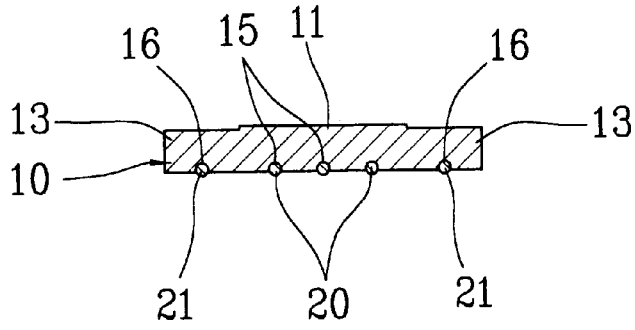
FIG. 4 is a sectional view of one metal unit.
Figure 5:
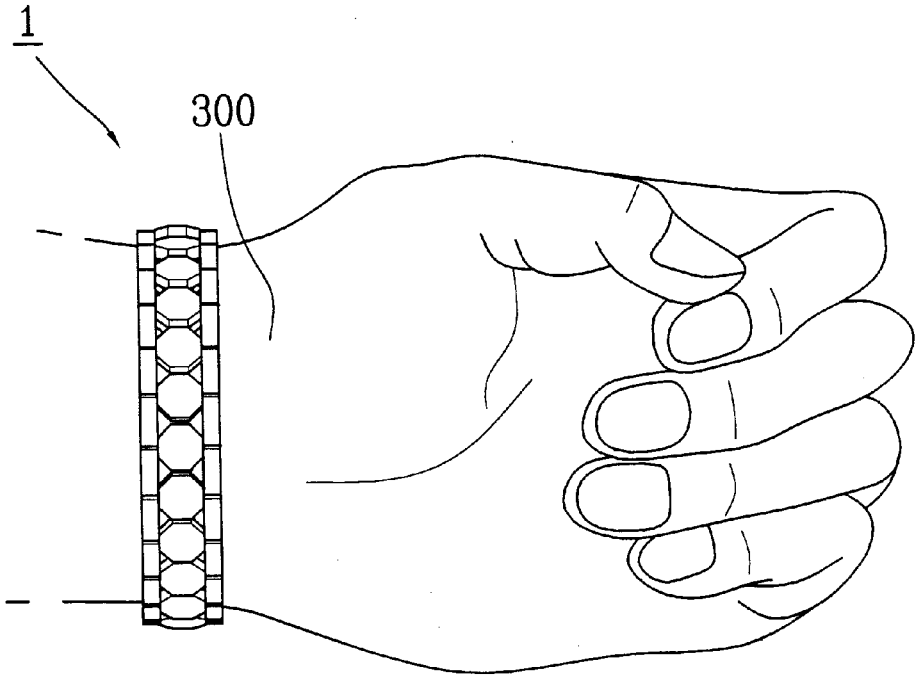
FIG. 5 is a perspective view of the bracelet worn on a wrist.

As shown in FIGS. 4 and 5, bracelet 1 is placed on wrist 300 by positioning it in a manner so that the inner surfaces of body part 11 and connected parts 13 of nonferrous metal units 10 contact the skin, and then locking member 100 is connected with linking member 200. When wearing the bracelet, gold rods 20, 21 inserted in a protruding manner from the inner surface body part 11 and connected parts 13 of nonferrous metal units 10 contact the skin and thus provide a stimulation effect on acupuncture points distributed on wrist 300.

Since the nonferrous metal units 10 carry anions and gold rods 20, 21 carry cations, the contact of these two metals accelerates an activation of cells or nerves. Cells or nerves in the human body are affected on their activation by an electric current. As such, acupuncture points distributed on the wrist are also highly affected as a kind of nerve cell by an electric current. That is, when getting sick, an electric current in the wrist becomes weak. In that case, a normal electric current can be recovered if gold rods 20, 21 contact the acupuncture points distributed on wrist 300.

Figure 6:
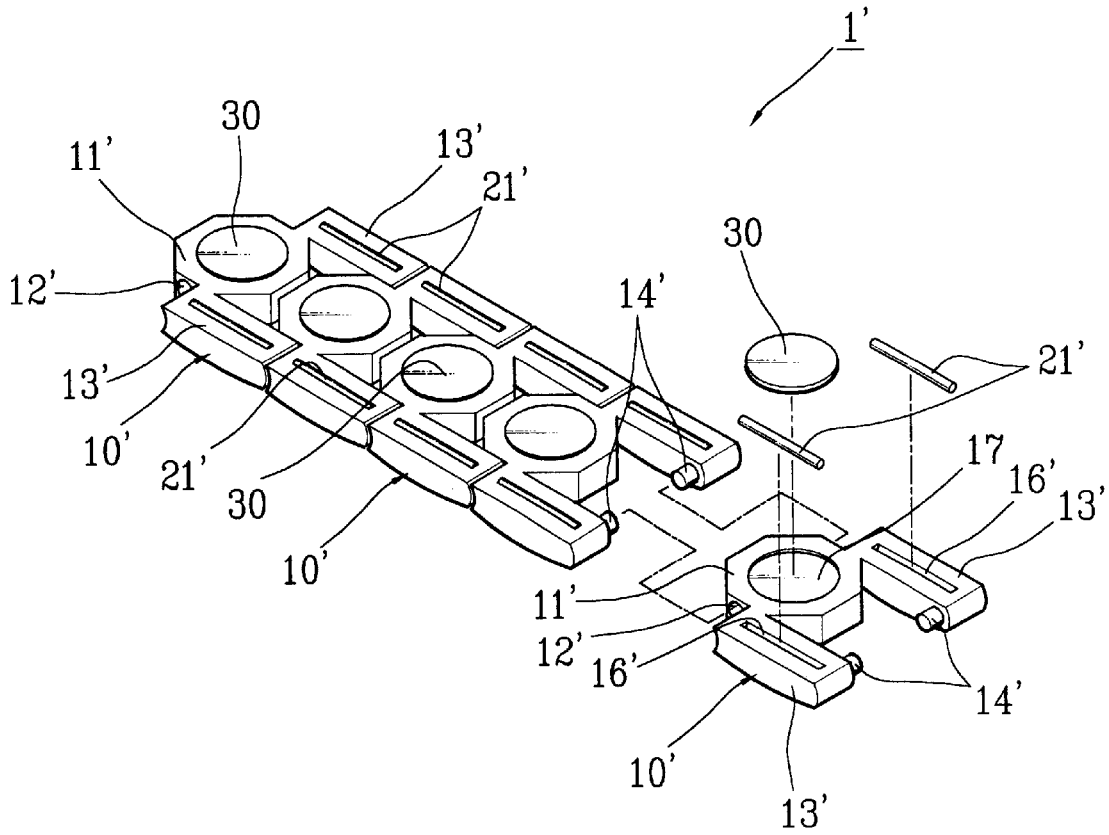
FIG. 6 is an exploded perspective view of the inner side of the metal units according to another embodiment of the present invention.
Figure 7:
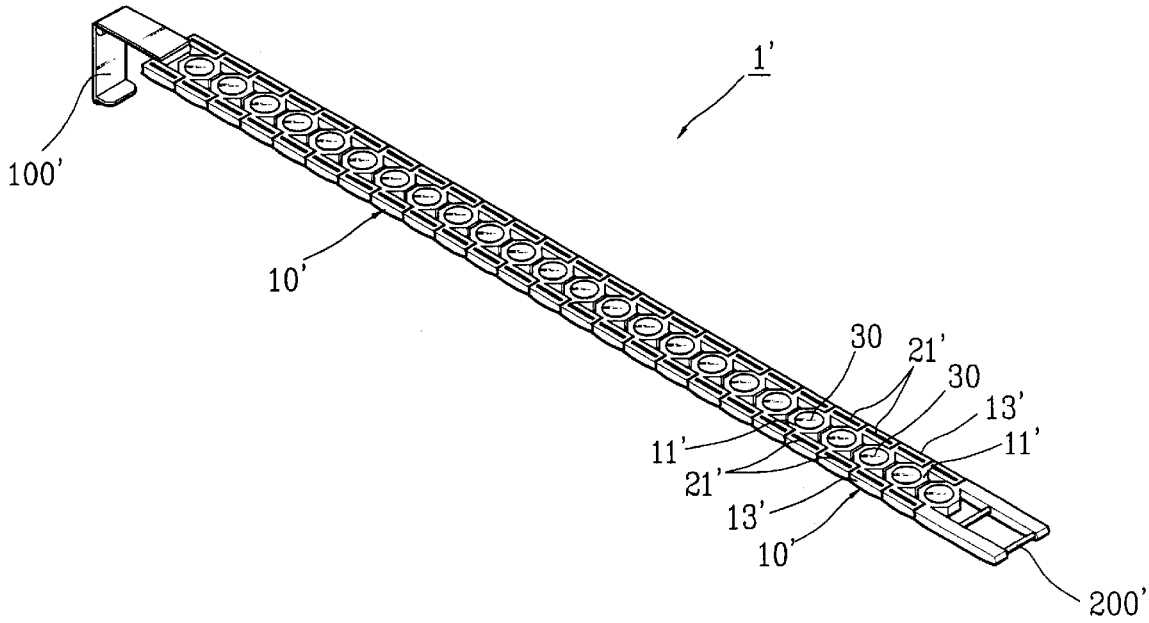
FIG. 7 is a perspective view of the inner side of the bracelet of FIG. 6 and, FIG. 8 is a sectional view of one metal unit of FIG. 6.
Figure 8:
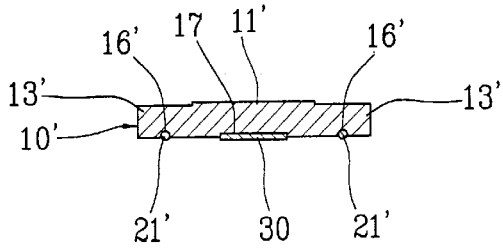

FIGS. 6 and 7 show another embodiment according to the present invention. A bracelet 1' according to this embodiment comprises a series of nonferrous metal units 10', a locking member 100' at one end and a linking member 200' at the other end. Each metal unit 10' includes a body part 11' and right and left connection parts 13'. Body part 11' has a circular groove 17 in the inner surface and a circular gold plate 30 is inserted thereinto so as to project partially therefrom. Connection parts 13' have long grooves 16' in the inner surface, and gold rods 21' are inserted thereinto so as to protrude therefrom. As described above, when wearing the bracelet on a wrist 300, a circular gold plate 30 and gold rods 21' inserted in a protruding manner in the inner surface of nonferrous metal units 10' contact the skin and thus provide a stimulation effect on acupuncture points distributed on wrist 300. In addition to such effect, ionization on the skin is accelerated by the contact of nonferrous metal carrying anions with gold metal carrying cations.

As mentioned above, bracelet 1 of the present invention is provided to stimulate acupuncture points distributed on wrist 300. Continuous acupressure stimulation by gold rods 20, 21 inserted in a protruding manner in the inner surface of body part 11 and connected parts 13 of nonferrous metal units 10 results in activating blood circulation. Further, since the two heterogeneous metals contact the skin, an electric current occurs. This enables the activation of cells or nerves to accelerate.

Since gold rods which contact the skin carry cations and the nonferrous metal units carry anions, the contact of these two metals accelerates an ionization of anions and cations. This in turn accelerates an electric activation on acupuncture points distributed on wrist 300 and thereby prevents diseases.

A bracelet 1' of another embodiment according to the present invention as shown in FIG. 6, comprises a series of nonferrous metal units 10' of which body part 11' has a circular groove 17 in the inner surface and a circular gold plate 30 is inserted thereinto in a projecting manner. When wearing the bracelet on a wrist 300, a circular gold plate 30 and gold rods 21' inserted in a protruding manner in the inner surface of the nonferrous metal units 10' contact the skin and thus provide a stimulation effect on acupuncture points distributed on wrist 300. In addition to such effect, ionization on the skin is accelerated by contact of the nonferrous metal carrying anions with gold metal rods 21' and circular gold plates 30 carrying cations. These stimulation and ionization effects can prevent diseases.

What is claimed is:

1. A bracelet comprising:

a series of nonferrous metal units, each of said metal units including:

a body part including:

an inner surfaces;

several grooves in the inner surface, opposite side surface, and a connection hole at each of the opposite side surfaces, and right and left connection parts extending from the body part, each right and left connection part including a rod that protrudes from the connection part such that adjacent metal units are linked together by engagement of the connection holes with the rods, each connection part further including an inner surface and grooves in the inner surfaces, and gold members inserted into the grooves of the body part and the connection parts so as to protrude partially out therefrom;

a locking member at one end of the series of nonferrous metal units; and a linking member at an opposite end of the series of nonferrous metal units for connecting with the locking member to secure the bracelet around a wrist of a person.

2. A bracelet according to claim 1, wherein the groove in each body part is circular and the gold member inserted in each circular groove is a circular gold plate.

3. A bracelet according to claim 1, wherein the groove in each body part is elongated and the gold member inserted in each elongated groove is a gold rod.

4. A bracelet according to claim 1, wherein the groove in each connection part is elongated and the gold member inserted in each elongated groove is a gold rod.

* * * * *